US006453859B1

(12) United States Patent
Smith et al.

(10) Patent No.: US 6,453,859 B1
(45) Date of Patent: Sep. 24, 2002

(54) MULTI-MODE CONTROL SYSTEM FOR VARIABLE CAMSHAFT TIMING DEVICES

(75) Inventors: Frank R. Smith, Cortland; Braman C. Wing; Marty Gardner, both of Ithaca; Mike Duffield, Willseyville, all of NY (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/918,629

(22) Filed: Jul. 31, 2001

Related U.S. Application Data

(60) Provisional application No. 60/260,309, filed on Jan. 8, 2001.

(51) Int. Cl.[7] ..... F01L 1/34

(52) U.S. Cl. ..... 123/90.17; 123/90.15; 74/568 R; 464/1; 464/2

(58) Field of Search ..... 123/90.15, 90.16, 123/90.17, 91.18; 74/568 R; 464/1, 2, 160

(56) References Cited

U.S. PATENT DOCUMENTS 4,858,572 A 8/1989 Shirai et al.
5,337,711 A * 8/1994 Hampton ..... 123/90.17
5,645,017 A 7/1997 Melchior
5,675,725 A 10/1997 Butterfield et al.

* cited by examiner

*Primary Examiner*—Thomas Denion
*Assistant Examiner*—Jamie Corrigan
(74) *Attorney, Agent, or Firm*—Greg Dziegielewski; Thomas A. Meehan; Emch, Schaffer, Schaub & Porcello Co., L.P.A.

(57) ABSTRACT

A variable camshaft timing apparatus (10) includes a pulse actuating circuit (24A,50,44,56,60,24R and 24R,52,46,54,58,24A) for oscillating the variable camshaft timing apparatus in reaction to fluid under pulsation, and includes a pressure actuating circuit (30,34,36,40,44,50,24A,24R,52,46,66,80/180,32 and 30,34,38,42,46,52,24R,24A,50,44,64,80/180,32) for oscillating the variable camshaft timing device in reaction to fluid under pressure. Advance and retard valves (44,46) are interconnected with the pulse and pressure actuating circuits for independently and simultaneously activating the pulse and pressure actuating circuits. Finally, an exhaust valve (80,180, 280) is positioned in fluid communication with the pulse and pressure actuating circuits, such that the variable camshaft timing device may be oscillated using one or both of the pulse actuating and pressure actuating circuits, and may be maintained in position using one or both of the pulse actuating and pressure actuating circuits.

18 Claims, 13 Drawing Sheets

MULTI-MODE CONTROL SYSTEM FOR VARIABLE CAMSHAFT TIMING DEVICES

CROSS-REFERENCE TO RELATED APPLICATION

This application is based, in part, on provisional U.S. patent application No. Ser. 60/260,309, which was filed on Jan. 8, 2001.

BACKGROUND OF THE INVENTION

1. Field of the Invention

The present invention generally relates to an internal combustion engine having a control system for controlling the operation of a variable camshaft timing mechanism (VCT) of the type in which the position of a camshaft is circumferentially varied relative to the position of a crankshaft. More specifically, this invention relates to control systems for operating VCT devices in response to fluid under continuous pressure and fluid under pulsation to selectively advance, retard, or maintain the position of the camshaft.

2. Description of the Prior Art

It is known that the performance of an internal combustion engine can be improved by the use of dual overhead camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft-powered chain drive or belt drive. It is also known that the performance of an internal combustion engine having dual overhead camshafts, or but a single camshaft, can be improved by changing the positional relationship of a camshaft relative to the crankshaft.

It is also known that engine performance in an engine having one or more camshafts can be improved by varying camshaft timing, specifically in terms of idle quality, fuel economy, reduced emissions, or increased torque. For example, the camshaft can be "retarded" for delayed closing of intake valves at idle for stability purposes and at high engine speed for enhanced output. Likewise, the camshaft can be "advanced" for premature closing of intake valves during mid-range operation to achieve higher volumetric efficiency with correspondingly higher levels of torque. In a dual overhead camshaft engine, retarding or advancing the camshaft is accomplished by changing the positional relationship of one of the camshafts, usually the camshaft that operates the intake valves of the engine, relative to the other camshaft and the crankshaft. Accordingly, retarding or advancing the camshaft varies the timing of the engine in terms of the operation of the intake valves relative to the exhaust valves, or in terms of the operation of the valves relative to the position of the crankshaft.

There are a multitude of VCT architectures using actuating components that include piston-cylinder devices, hub and vanes, single lobe vanes, and opposed lobe vanes. Similarly, there are at least three distinct styles of VCT actuation in the prior art. The first style is referred to hereafter as an Oil Pressure Actuated (OPA) VCT. The OPA system includes a VCT responsive to fluid under continuous pressure generated by an engine oil pump. The second style is referred to hereafter as a Camshaft Torque Actuated (CTA) VCT. The CTA system includes a VCT responsive to fluid under pulsations generated by torque pulses in the camshaft. The third style is referred to hereafter as a multi-mode VCT. The multi-mode system includes a VCT responsive to both fluid under pressure and under pulsation to oscillate the camshaft.

With OPA devices, the VCT uses fluid output of an engine oil pump where the actuation rate of the VCT is limited by the available hydraulic power supplied by the pump. Many such VCT systems incorporate hydraulics including a hub having multiple circumferentially spaced vanes cooperating within an enclosed housing having multiple circumferentially opposed walls. The vanes and the walls cooperate to define multiple fluid chambers, and the vanes divide the chambers into first and second sections. For example, U.S. Pat. No. 4,858,572 (Shirai et al.) teaches use of such a system for adjusting an angular phase difference between an engine crankshaft and an engine camshaft using oil pressure from a pump. Shirai et al. discloses fluid circuits having check valves, a spool valve and springs, and electromechanical valves. Fluid is transferred from the first section to the second section, or vice versa, to thereby oscillate the vanes and hub with respect to the housing in one direction or the other. Each branch of the fluid flow path runs from one section to the other through a drainage clearance between the hub and the camshaft, back through the oil pump, and then through the spool valve and a check valve. The check valve prevents fluid from flowing out of each section back to the spool valve.

With CTA devices, the VCT uses the energy of reactive torques in the camshaft to power the VCT hydraulically through a check-valve fluid circuit. The camshaft is subjected cyclically to resistant torques when the rising profiles of the cam lobes open the valves against the action of the valve springs, and then to driving torques when the valve springs close the valves by causing them to follow along the descending profiles of the cam lobes. The alternating resistant and driving torques in the camshaft translate into slight pulsations in the vane. These pulsations result in alternating pressure differentials across the vane that alternately compress the fluid in the advance and retard fluid chambers. To retard the camshaft, fluid is allowed to escape during the pulsations from the advance chamber and flow to the retard chamber through one branch of a one-way fluid circuit. Alternately, to advance the camshaft, fluid is allowed to escape during the pulsations from the retard chamber to the advance chamber through another branch of a one-way fluid circuit. Accordingly, the VCT changes phase by exchanging fluid from one fluid chamber to the other using the differential in pressure of the fluid in the fluid chambers to increase the volume of one fluid chamber at the expense of the other.

For example, U.S. Pat. 5,645,017 to (Melchior) teaches use of a torque pulse actuated VCT to change phase of a camshaft. The '017 patent discloses a vane type VCT having a vane within a housing that delimits opposing antagonistic chambers that are interconnected by two unidirectional circuits having opposite flow directions. A valve communicates with the two unidirectional circuits so as to transfer fluid from one antagonistic chamber to the other in response to alternating pressure differentials between the antagonistic chambers, where the pressure differentials result solely from torque pulsations in the camshaft and vane.

In the systems described above, VCT actuation is accomplished in response to torque pulsation in the camshaft or in response to engine oil pressure from an engine oil pump, but not both. This presents a significant disadvantage.

First, there are shortcomings to using only the CTA powered VCT. The CTA device has a significantly lower frequency response than the OPA device, even though the potential actuation rate of the CTA device is substantially higher than the OPA device due to the larger amount of energy in the cam torque inputs. For example, inline four cylinder engines typically operate at relatively high speeds and therefore generate very high frequency torque pulses to which CTA systems do not respond quickly enough to cause actuation of the VCT. Thus, the relatively low frequency response of the CTA system results in a dramatic drop in CTA performance at the higher engine speeds of the inline four cylinder engines. Similarly, inline six cylinder engines typically exhibit low amplitude camshaft torque pulses that are also inadequate to actuate the VCT.

In contrast, the OPA systems have nearly the opposite problem. Since the actuation rate of the OPA device is strongly dependent on engine oil pressure, the device performs well at higher engine speeds, when the oil pump is producing an abundance of oil pressure. At lower engine speeds, however, particularly when the engine is running hot, the performance suffers because the oil pump is producing relatively little oil pressure.

Because the OPA device performs well at high speed and the CTA performs well at lower speeds, it would be advantageous to combine both strategies and architectures into one multi-mode VCT device and be able to selectively switch between the two independently and/or use both simultaneously. For example, U.S. Pat. 5,657,725 (Butterfield et al.), which is assigned to the assignee hereof teaches uses of a dual-mode VCT system to change phase of a camshaft. The '725 patent discloses a dual-mode device responsive to torque pulses and/or engine oil pump pressure for actuation. In the '725 patent there is disclosed a VCT apparatus having a vane within a housing that delimits opposing advance and retard chambers that are interconnected by an hydraulic circuit having two check valves and a spool valve therein. Here, fluid flows from one chamber to the other, through one check valve and then through the spool valve, in response to sufficiently strong torque pulsations in the vane. When there are not sufficiently strong pulsations present in the vane, fluid flows from the one chamber, not through the check valve, but directly through the spool valve to exhaust. Simultaneously, make-up fluid from the engine oil pump flows through the spool valve both directly to the other chamber and indirectly to the other chamber, by cycling in parallel through the other check valve back through the spool valve.

While the '725 patent discloses a significant improvement upon the prior art, there are still some disadvantages. For example, the system is two-position only and is not capable of maintaining position between fully advanced and fully retarded positions. Additionally, the system uses a relatively complicated hydraulic circuit and spool valve system.

Accordingly, what is needed is a multi-mode VCT system that is capable of advancing, retarding, and maintaining a camshaft in intermediate positions over the entire speed range of an engine and uses relatively inexpensive and uncomplicated and hydraulic circuitry and components.

SUMMARY OF THE INVENTION

According to the present invention there is provided a multi-mode VCT system that is capable of advancing, retarding, and maintaining a camshaft in intermediate positions over the entire speed range of an engine and uses relatively inexpensive and uncomplicated and hydraulic circuitry and components.

The present invention includes a variable camshaft timing device including a pulse actuating circuit for oscillating the variable camshaft timing device in reaction to fluid under pulsation. A pressure actuating circuit is included for oscillating the variable camshaft timing device in reaction to fluid under pressure. Advance and retard valves are interconnected with the pulse and pressure actuating circuits for independently and simultaneously activating the pulse and pressure actuating circuits. Finally, an exhaust valve is positioned in fluid communication with the pulse and pressure actuating circuits, whereby the variable camshaft timing device may be oscillated using one or both of the pulse actuating and pressure actuating circuits, and may be maintained in position using one or both of the pulse actuating and pressure actuating circuits.

Accordingly, it is an object of the present invention to provide an improved variable camshaft timing device for varying camshaft timing in an internal combustion engine.

It is another object to provide a multi-mode variable camshaft timing device that is capable of operating in response to fluid under pressure from a pump and fluid under pulsations from alternating camshaft torques.

It is yet another object to provide a multi-mode variable camshaft timing device that is capable of maintaining position anywhere between a fully advanced and fully retarded position over the full range of engine speed, and does not necessarily require use of a spool valve, but may as an option.

These objects and other features, aspects, and advantages of this invention will be more apparent after a reading of the following detailed description, appended claims, and accompanying drawings.

BRIEF DESCRIPTION OF THE DRAWINGS

FIG. 1 is an exploded perspective view of a VCT device according to the preferred embodiment of the present invention;

DETAILED DESCRIPTION OF THE PREFERRED EMBODIMENT

In general, an hydraulic timing system is provided for varying the phase of one rotary member relative to another rotary member. More particularly, the present invention provides a multi-mode Variable Camshaft Timing system (VCT) that is powered by, or is responsive to, engine oil under pressure from a pump and/or from engine oil under pressure pulsations inherent as a result of the tongue pulsations that occur in a rotating camshaft. While the present invention will be described in detail with respect to internal combustion engines, the VCT system is also well suited to other environments using hydraulic timing devices. Similarly, the fluid medium described herein is preferably engine oil, but any other standard hydraulic fluid may be used. Accordingly, the present invention is not limited to only internal combustion engines.

Figure 1A:
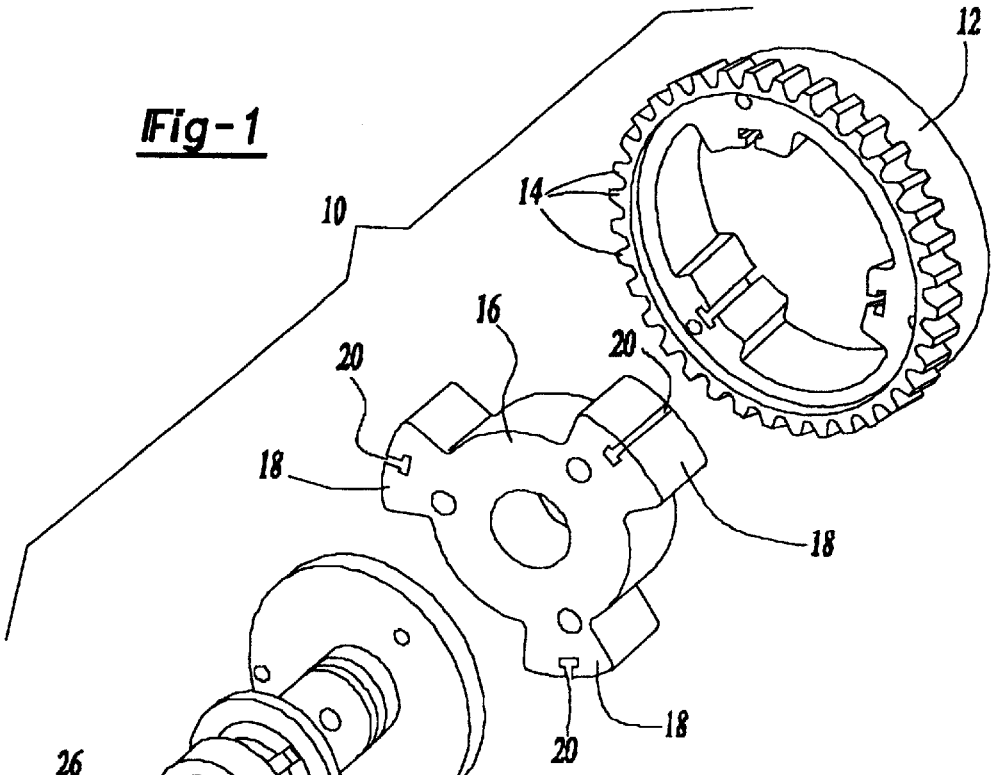
FIG. 1A is an end view of the device of FIG. 1 in its assembled state.
Figure 1A:
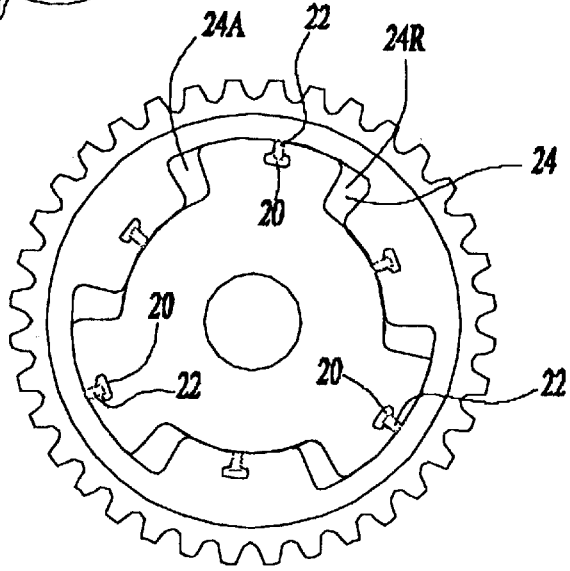

Referring now in detail to the Figures, there is shown in FIG. 1 a VCT apparatus 10 according to the preferred embodiment of the present invention. It is contemplated that the VCT apparatus 10 operates under control of an engine control module as is commonly known in the art. The VCT apparatus 10 includes a housing 12 having sprocket teeth 14 circumferentially disposed around its periphery. The housing 12 circumscribes a hub 16 to define fluid chambers 24 therebetween. The hub 16 is mechanically connected to a camshaft 26 to be rotatable therewith but not oscillatable with respect thereto. The hub 16 is in fluid communication with the camshaft 26 via passages (not shown) as is commonly known in the art. The hub 16 includes circumferentially spaced lobes 18 extending radially outwardly to divide each fluid chamber 24 into advance and retard chambers 24A and 24R, as shown in FIG. 1A. Each lobe 18 includes a slot 20 therein for housing a vane 22. The vane 22 cooperates with the inside of the housing 12 to seal the advance and retard chambers 24A and 24R so that they are fluid tightly separated from one another.

Referring again to FIG. 1, the assembly that includes the camshaft 26 with the hub 16 and housing 12 is caused to rotate by torque applied to the housing 12 by an endless chain (not shown) that engages the sprocket teeth 14 so that rotation is imparted to the endless chain by a rotating crankshaft (also not shown). The use of a cogged timing belt to drive the housing 12 is also contemplated. Rotation, in turn, is imparted from the housing 12 to the hub 16 through fluid in the fluid chambers 24A and 24R.

The hub 16 can be circumferentially retarded or advanced in position with respect to the housing 12. Therefore, the housing 12 rotates with the camshaft 26 and is oscillatable with respect to the camshaft 26 to change the phase of the camshaft 26 relative to the crankshaft. The VCT hardware, as opposed to the VCT 10 as a system, may be of any architecture that is well known in the art. Accordingly, examples of well known VCT hardware architectures include those of commonly assigned U.S. Pat. No. 5,107,804 (Becker et al.) and the aforesaid '725 patent, which are also incorporated by reference herein. In addition to the VCT hardware, an oscillation control configuration is required to oscillate the VCT apparatus 10, and is described below.

Figure 2:
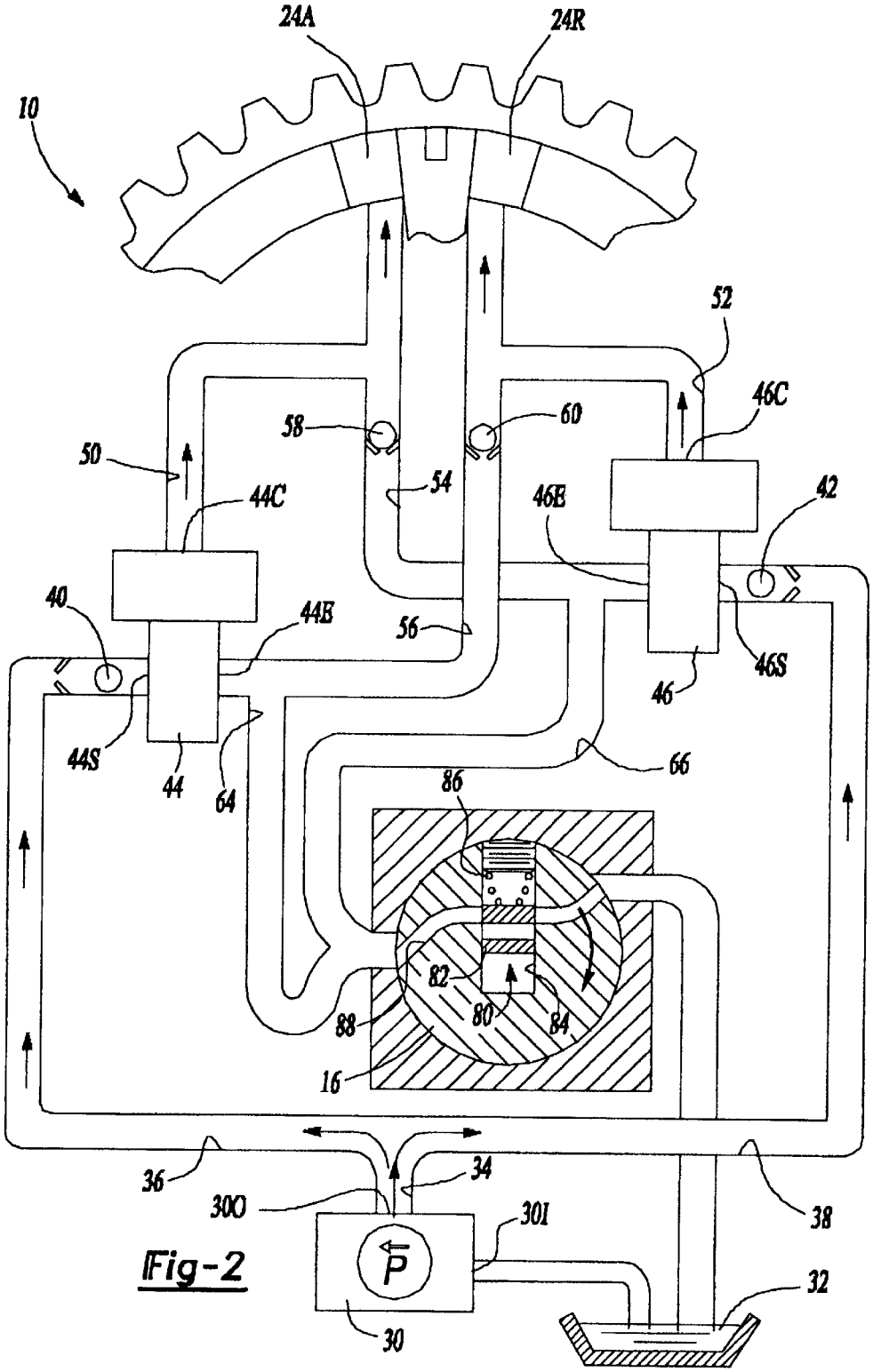
FIG. 2 is a schematic view of a VCT control system according to the preferred embodiment of the present invention, where the VCT is maintaining position.

To complement the hardware example shown in FIG. 1, FIG. 2 illustrates a schematic of the VCT apparatus 10 of the present invention. It is contemplated, and is well known in the art, that VCT control systems include fluid circuits that are drilled or otherwise machined or formed into the hardware components of the VCT apparatus 10. The exact location of passages and interconnections of such fluid circuitry is not critical to the present invention and is therefore only schematically illustrated.

Structurally, the control system for the VCT apparatus 10 can be described in terms of passages, valves, etc. A fluid pressure source such as an engine oil pump 30 is located upstream and is in fluid communication with the downstream advance and retard chambers 24A and 24R that are separated by the lobe 18. The engine oil pump 30 includes an inlet side 301 that communicates with a sump 32 of the engine oil system, and includes an opposite outlet side 300 that supplies oil to the advance and retard chambers 24A and 24R. The sump 32 collects oil from various parts of the control system to complete the circuits thereof An oil supply passage 34 fluidly communicates the outlet side 300 of the pump and branches into an advance branch passage 36 and a retard branch passage 38. The branch passages 36 and 38 include supply check valves 40 and 42, respectively, for permitting oil flow in a downstream direction from the pump 30 but prevents oil flow in an upstream direction back toward the pump 30. In other words, the check valves 40 and 42 prevent counterflow back to the pump 30.

Downstream of each check valve, each branch passage 36 and 38 terminates in an advance or retard valve 44 or 46, respectively. Preferably, the valves 44 and 46 are pulse width modulated (PWM) valves, having a supply port 44S or 46S in fluid communication with the oil supply passage 34. Each of the valves 44 and 46 also include a control port 44C or 46C in fluid communication with one end of an advance or retard chamber passage 50 or 52. An opposite end of the chamber passage 50 or 52 fluidly communicates with one of the advance or retard chambers 24A and 24R. Each valve 44 or 46 finally includes an exhaust port 44E or 46E communicable with the control port 44C or 46C and in fluid communication with both a pulse passage 54 or 56 and an exhaust passage 64 or 66. Each pulse passage 54 or 56 includes one end in communication with the valve 44 or 46, and an opposite end in communication with one of the advance or retard chambers 24A and 24R and with one of the corresponding chamber passages 50 and 52. Each pulse passage 54 and 56 includes a pulse check valve 58 and 60, respectively, just upstream of the connection with the chamber passage 50 or 52 to prevent upstream oil flow through the pulse passage 54 or 56, or in other words, to prevent counterflow from the chamber 24A or 24R toward the valve 44 or 46. Each exhaust passage 64 and 66 includes one end in communication with the exhaust port 44E or 46E, respectively, of the valve 44 or 46 and with an exhaust valve 80, such that the exhaust valve 80 terminates each of the exhaust passages 64 and 66. Accordingly, the exhaust valve 80, as shown in FIG. 2 includes a piston 82 that is radially disposed within a radial valve passage 84 within the hub 16.

A spring 86 supports the valve 80 in a valve closed position, such that a combined exhaust passage 88 is blocked by the valve 80. The spring force may be chosen in accordance with a calculation of the rotational speed of the engine, to establish the desired valve opening condition, as is well known. In the valve open position, the exhaust valve 80 and combined exhaust passage 88 communicate with the sump 32 of the engine either via passageways or by draining down through gaps between engine components, which is consistent with designs well known in the art. The PWM valves 44 and 46 and the exhaust valve 80 are preferably controlled by a central source such as an engine control unit or the like, as is well known in the art.

Systemically, the VCT control system can be described in terms of circuits defined from the structure described above. The VCT control system includes a pulse actuating circuit and a pressure actuating circuit. The pulse actuating circuit is further divided into a retard pulsing path, an advance pulsing path, and a make-up oil circuit. The retard pulsing path includes in fluid communication, the advance chamber 24A, the advance chamber passage 50, the advance PWM valve 44, the retard pulse passage 56, and the retard chamber 24R. Similarly, the advance pulsing path includes in fluid communication, the retard chamber 24R, the retard chamber passage 52, the retard PWM valve 46, the advance pulse passage 54, and the advance chamber 24A. Additionally, since the system is not perfectly sealed against oil loss, the make-up oil circuit is necessary and is defined by the oil supply passage 34, the valve 44 or 46, the chamber passage 50 or 52, and the chamber 24A or 24R.

Similarly, the pressure actuating circuit is further divided into a pressure supply path and a pressure exhaust path. The pressure supply path includes in fluid communication, the oil supply passage 34, one check valve 40 or 42, one valve 44 or 46, the chamber passage 50 or 52, and the chamber 24A or 24R. The pressure exhaust path includes in fluid communication, the other chamber 24A or 24R, the other chamber passage 50 or 52, the other valve 44 or 46, the exhaust passage 64 or 66, and the exhaust valve 80.

In operation, the VCT apparatus 10 oscillates or maintains position anywhere in and between a fully retarded position and a fully advanced position. In the fully retarded position, the volume of the advance chamber 24A would be approximately zero, while the volume of the retard chamber 24R would be at a maximum. The reverse is true for the VCT apparatus 10 in the fully advanced position. To maintain any position intermediate the fully advanced and fully retarded positions, the VCT apparatus 10 of the present invention operates under closed loop control. In other words, as is well known, the VCT system communicates with position feedback sensors that monitor the relative position of the camshaft. The position feedback is used by the VCT system in further controlling the phase of the VCT apparatus 10.

In FIG. 2, the VCT apparatus 10 is shown maintaining position halfway between the fully advanced and retarded positions. To achieve this result, the pressure actuating circuit is activated to supply oil to both the advance and retard chambers 24A and 24R simultaneously. Accordingly, oil flows from the pump 30 through the oil supply passage 34 into each oil supply branch 36 and 38. The oil continues through each check valve 40 and 42 and into the supply port 44S or 46S of each valve 44 or 46. Each valve 44 or 46 is positioned in an exhaust port-closed position to direct oil out of the control port 44C and 46C and through the chamber passage 50 or 52 into the respective chamber 24A or 24R. The pulse check valves 58 and 60 remain closed against their seats under fluid pressure from the chamber passage 50 or 52. Thus each chamber 24A or 24R experiences the same fluid pressure from the pump 30 through each respective branch of the control system. Here, no fluid pressure from the pump 30 reaches the exhaust passages 64 or 66. Accordingly, the exhaust valve 80 may remain closed, or may be open, because the state of the exhaust valve 80 will have no significant effect in this control system state.

Figure 3:
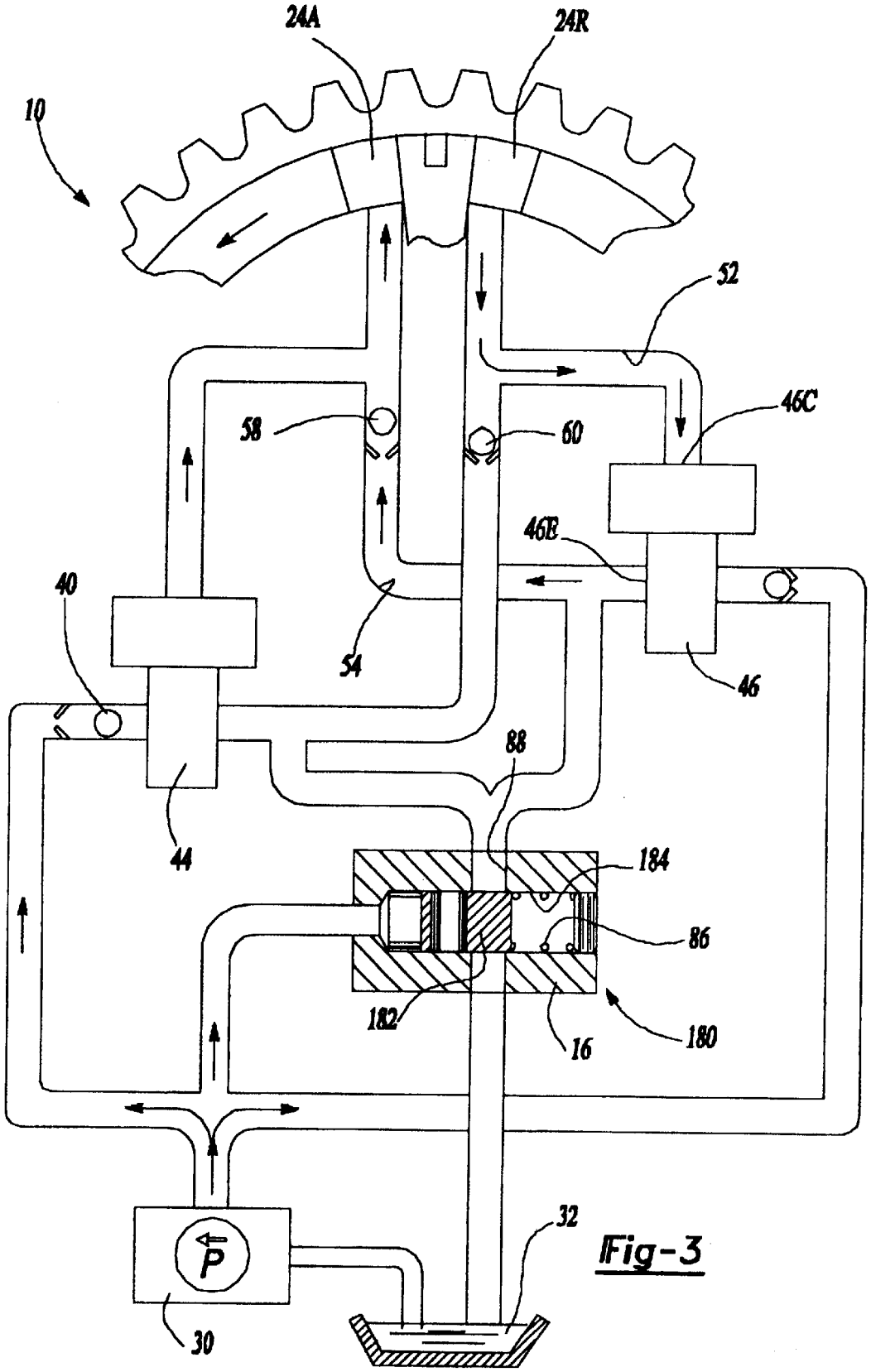
FIG. 3 is a schematic view of a VCT control system of the present invention showing an alternative valve, where the VCT is advancing under cam torque actuation.

FIG. 3 illustrates the control system in an advancing state under cam torque actuation. Cam torque actuation operates in response to reactive camshaft torques as previously described in the Background section above. Here, the advance valve 44 remains in the exhaust-closed position, while the retard valve 46 is moved to a source closed position. An exhaust valve 180 takes a closed position. Accordingly, each torque pulsation of the VCT apparatus 10 in the advancing direction acts to momentarily compress the oil in the retard chamber 24R. This compression causes the oil in the retard chamber 24R to escape therefrom into the advancing pulsing path: through the retard chamber passage 52, into the control port 46C of the advance valve 46 and out the exhaust port 46E, through the advance pulse passage 54, past the check valve 58, and into the advance chamber 24A. Check valve 60 prevents pulsing oil from circumventing the advance valve 44. Make up oil flows from the pump 30, up through the advance valve 44 and into the advance chamber 24A. The supply check valve 40 prevents oil under pulsation from discharging back to the pump 30.

The exhaust valve 180 of FIG. 3 is actuated by engine oil pressure, and includes a spring-loaded piston 182 that is preferably axially disposed within an axial passage 184 within the hub 16. A spring 86 supports the valve 180 in a valve closed position, such that a combined exhaust passage 88 is blocked by the valve 180. As shown, the engine oil pressure is insufficient to displace the valve 180 for OPA operation.

Figure 4:
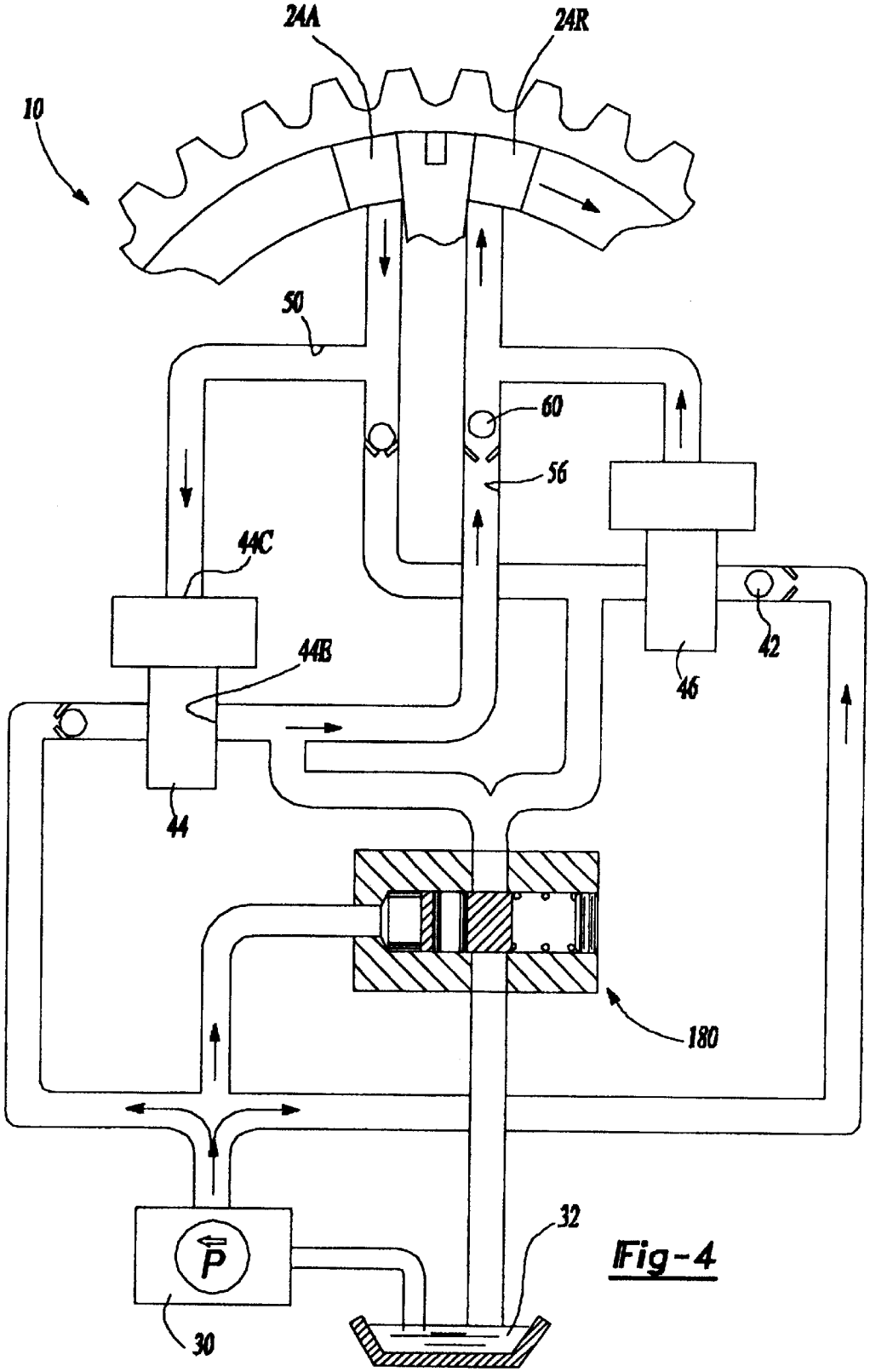
FIG. 4 is a schematic view of the VCT control system of FIG. 3, where the VCT is retarding under cam torque actuation.

FIG. 4 illustrates the mirror image of FIG. 3, the control system in a retarding state under cam torque actuation. Here, the retard valve 46 remains in the exhaust-closed position, while the advance chamber valve 44 is moved to a source closed position. Accordingly, each torque pulsation of the VCT apparatus 10 in the retarding direction acts to momentarily compress oil in each advance chamber 24A. This compression causes the oil in the advance chamber 24A to discharge therefrom into the retard pulsing path through the advance chamber passage 50, into the control port 44C of the valve 46 and out the exhaust port 44E of the valve 44, through the retarding pulse passage 56, past the check valve 60, and into the retard chamber 24R. The check valve 58 prevents pulsing oil from circumventing the pulsing path. Make-up oil flows from the pump 30, up through the retard valve 46 and into the retard chamber 24R. The supply check valve 42 prevents oil under pulsation from discharging back to the pump 30. The exhaust valve 180 of FIG. 4 is the same as that shown in FIG. 3.

Figure 5:
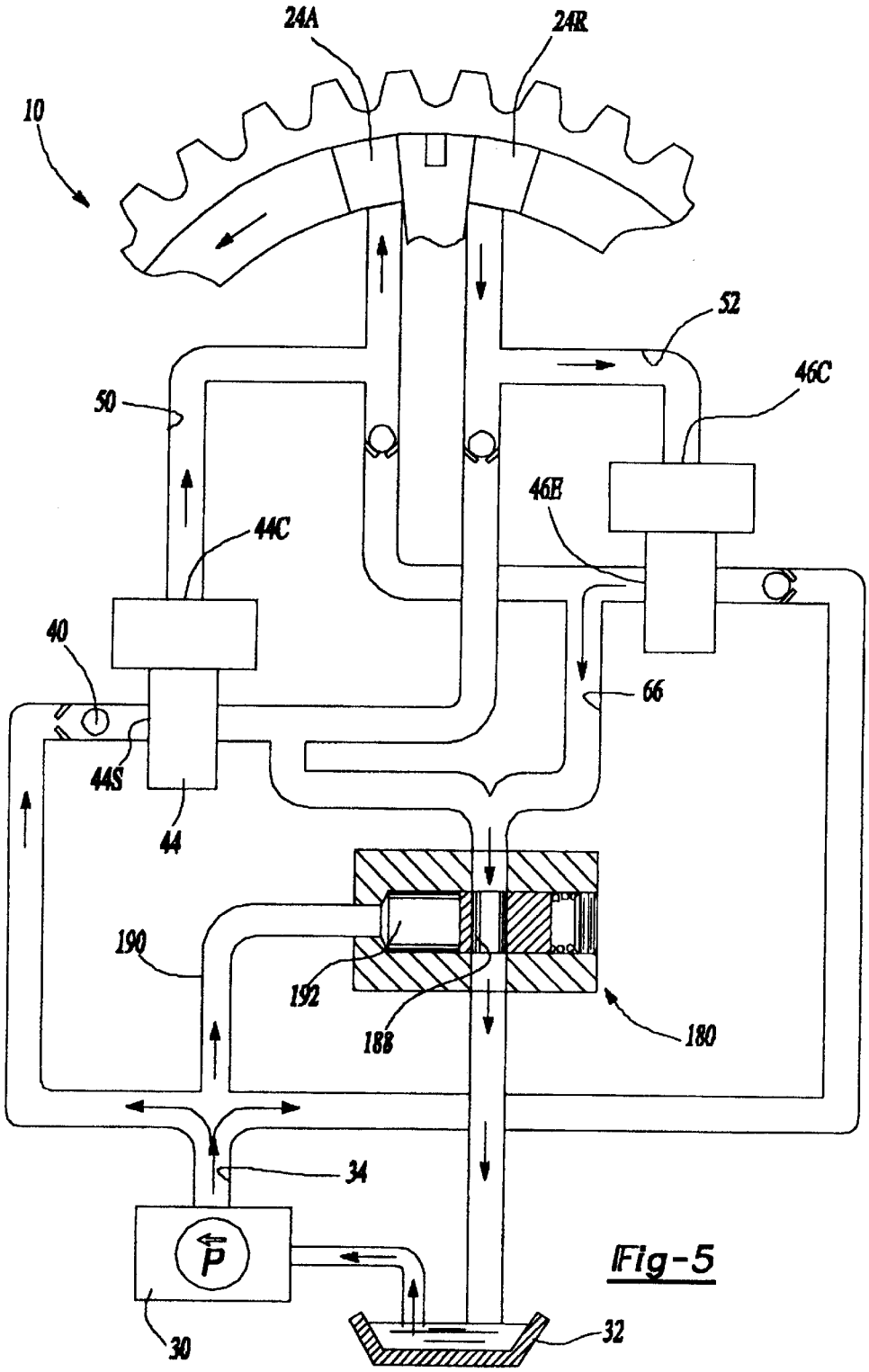
FIG. 5 is a schematic view of a VCT control system according to the present invention showing an oil pressure actuated exhaust valve, where the VCT is advancing under oil pressure actuation.

FIG. 5 illustrates the control system in an advancing state under oil pressure actuation. Oil pressure actuation operates in response to available hydraulic power of the engine as previously described in the Background section above. Here, oil flows under pressure from the pump 30 through the pressure actuating circuit. Specifically, oil flows through the check valve 40, into the supply port 44S of the valve 44 and out the control port 44C thereof, through the advance chamber passage 50, and into the for advance chamber 24A. Simultaneously, oil flows out of the retard chamber 24R, through the retard pulse passage 52, into the control port 46C of the valve 46 and out the exhaust port 46E thereof, through the exhaust passage 66, through the exhaust valve 180, and into the sump 32 to be recycled through the pump 30.

The exhaust valve 180 of FIG. 5 is the same as that of FIGS. 3 and 4 and is used as a switching means to invoke oil pressure actuation of the VCT apparatus 10. Here, the exhaust valve 180 is opened under fluid pressure from the engine oil pump 30 at higher engine speeds when CTA loses effectiveness. The exhaust valve 180 opens when sufficient engine oil pressure acts upon the valve 180 to overcome a predetermined spring force. An exhaust actuation passage 190 fluidly communicates an exhaust valve chamber 192 with the oil supply passage 34. Accordingly, oil constantly flows to the exhaust valve 180 but only acts to open the valve 180 under a minimum oil pressure in correlation with a predetermined engine speed sufficient to generate the minimum oil pressure. Therefore, the spring force is selected in accordance with a calculation of the oil pressure of the engine as balanced against the spring force to establish the desired valve opening condition. As shown in the valve open position, the exhaust valve 180 and a combined exhaust passage 188 communicate with the sump 32 of the engine either via passageways or by draining down and over components of the engine consistent with designs well known in the art.

Figure 6:
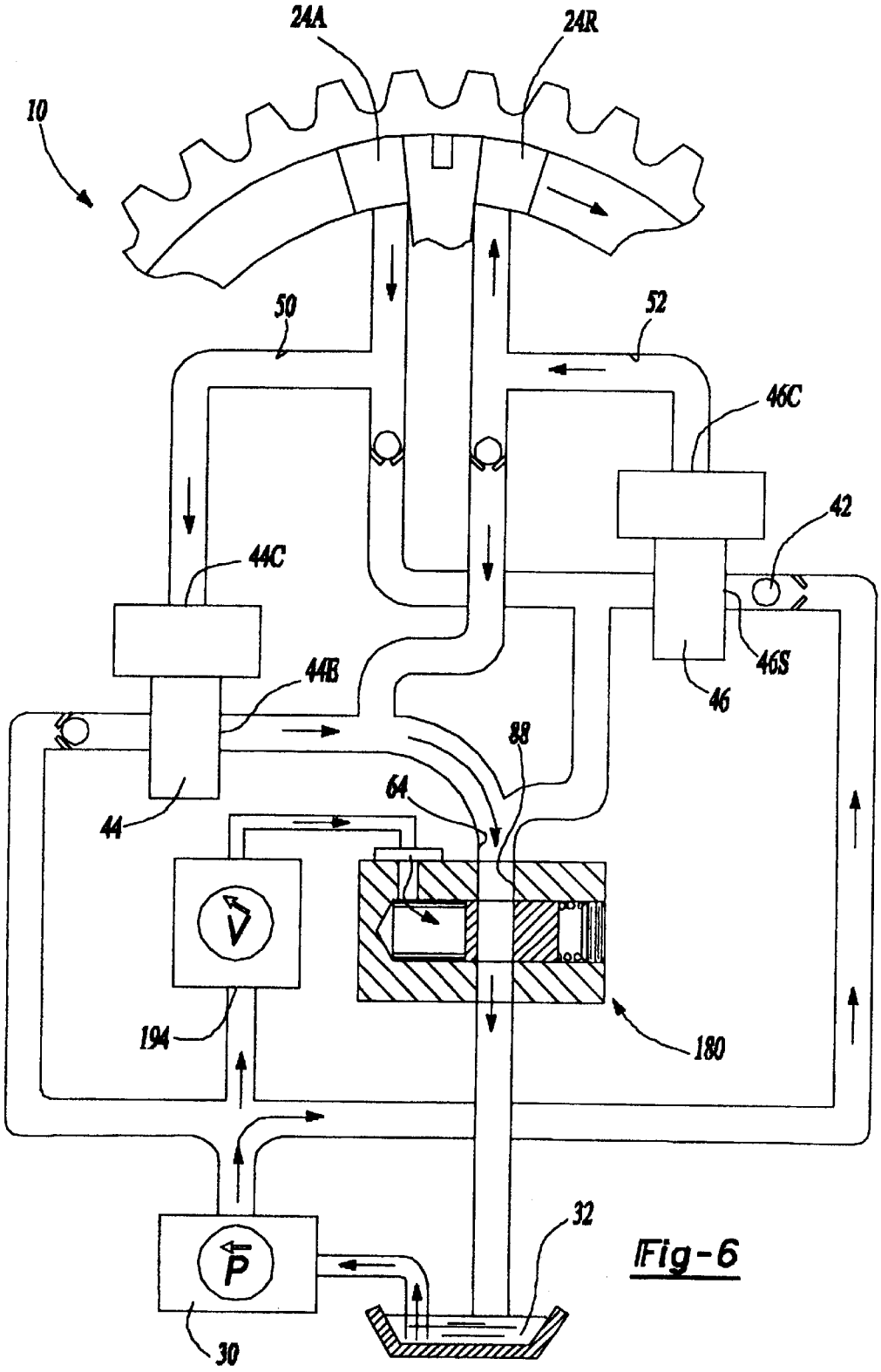
FIG. 6 is a schematic view of a VCT control system according to the present invention showing an electro-hydraulic actuated exhaust valve, where the VCT is retarding under oil pressure actuation.

FIG. 6 illustrates the mirror image of FIG. 5, the control system in a retarding state under oil pressure actuation. Oil flows under pressure from the pump 30 through the pressure actuating circuit. Oil flows thorough the check valve 42, into the supply port 46S of the retard valve 46 out the control port 46C thereof, through the retard chamber passage 52, and into the retard chamber 24R. Simultaneously, oil flows out of the advance chamber 24A, through the advance chamber passage 50 into the control port 44C of the advance valve 44 and out the exhaust port 44E thereof, through the exhaust passage 64, through the exhaust valve 180, and into the sump 32 to be recycled.

FIG. 6 also illustrates the exhaust valve 180 alternatively actuated by engine oil pressure controlled by a solenoid valve 194. Here, the exhaust valve 180 is actuated similar to that the exhaust valve 180 of FIG. 5, except the solenoid valve 194 controls actuation. Accordingly, a much lighter spring force may be selected such that the exhaust valve 180 will open under a relatively low engine speed and oil pressure, but only when the solenoid valve 194 is open. This will permit a much broader range of engine speed over which the exhaust valve 180 may open. Again, placement of hardware such as the solenoid valve 194 is not critical to the present invention and is engineered in accordance with techniques already well known in the art.

Figure 7:
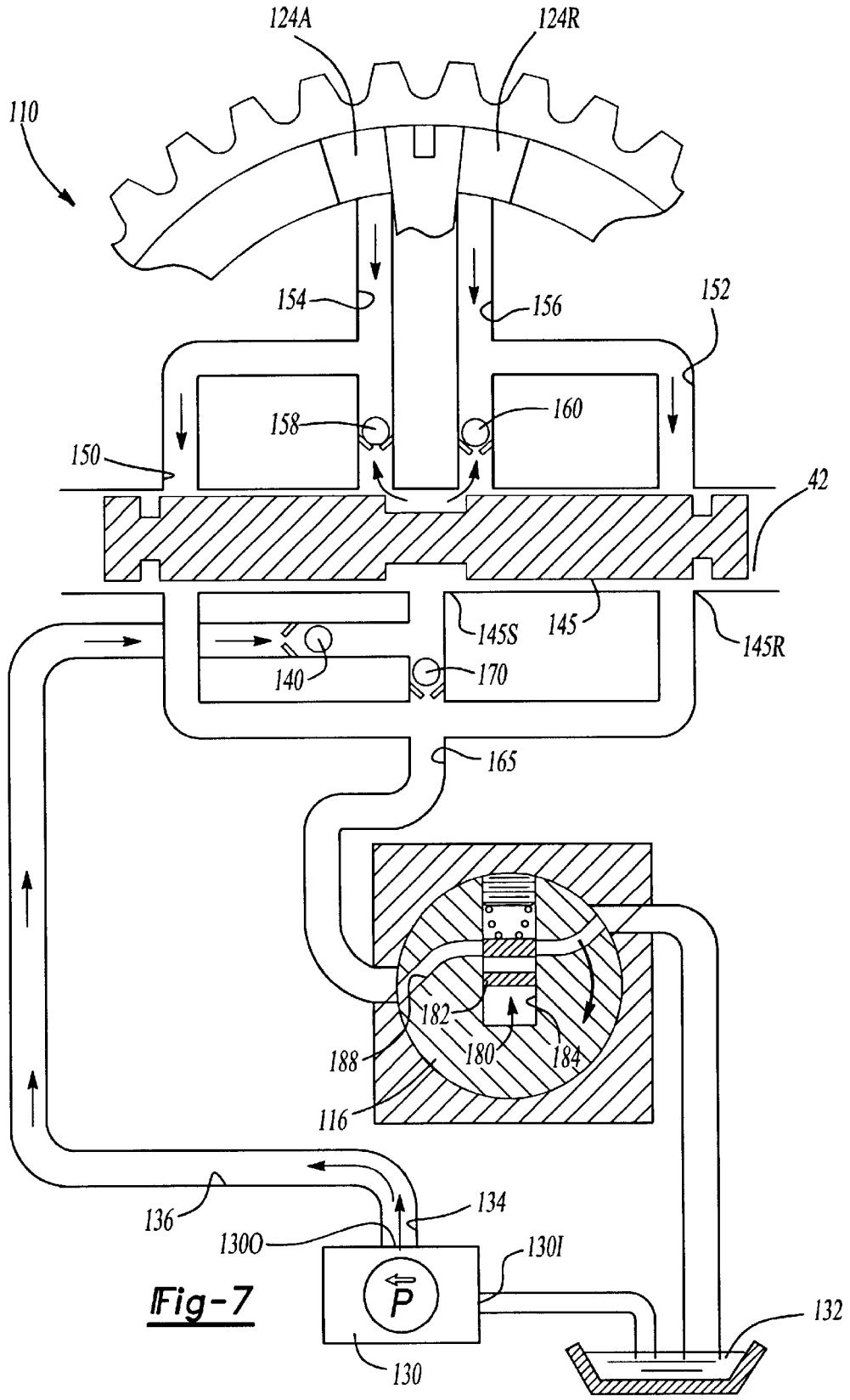
FIG. 7 is a schematic view of a VCT control system according to an alternative and the presently preferred embodiment of the present invention where the VCT is maintaining position.

FIG. 7, illustrates an alternative and the presently preferred embodiment of the present invention that uses a purely mechanical valving arrangement instead of the electro-mechanical valve arrangement of FIGS. 2 through 6. A VCT apparatus 110 is shown maintaining position halfway between the fully advanced and retarded positions. To achieve this result, the pressure actuating circuit is activated to supply oil to both advance and retard chambers 124A and 124R simultaneously. Accordingly, oil flows from a pump 130 through an oil supply passage 134 into an oil supply branch 136. The oil continues through a check valve 140 and into a supply port 145S of a spool valve 145.

The spool valve 145 is positioned in an exhaust port-closed position to direct oil through pulse passages 154 and 156 into the respective chambers 124A and 124R. The pulse check valves 158 and 160 open under fluid pressure from the oil supply branch 136. Thus each chamber 124A or 124R experiences the same fluid pressure from the pump 130 through each respective branch of the control system. Here, no fluid pressure from the pump 130 reaches an exhaust passage 165, because an exhaust check valve 170 blocks flow into the exhaust passage 165, and the spool valve 145 blocks flow from the chamber passages 150 and 152.

To advance in CTA mode, the spool valve 145 shifts to the left to open a retard chamber passage 152 to the exhaust passage 165, which is blocked by an exhaust valve 180 near a retard exhaust port 145R. Accordingly, oil pulsing from the retard chamber 124R deadheads at the retarding check valve 160, flows through the retard chamber passage 152 around the spool valve 145 on the right side, deadheads against the spool valve 145 in the advance chamber passage 150 on the left side, flows through the exhaust check valve 170 around the spool valve 145 into the advance pulse passage 154 past the advance check valve 158 and into the advance chamber 124A. Here, source oil alone may or may not be sufficient to change phase of the VCT apparatus 110, and, therefore, oil under pulsation is used to change phase of the VCT apparatus 110. To advance in OPA mode, the spool valve shifts to the left to open the retard chamber passage 152 to the exhaust passage 165, which would be open to a sump 132.

To retard in CTA mode, the spool valve 145 shifts to the right to open an advance chamber passage 150 to the exhaust passage 165, which is blocked by the exhaust valve 180 near an advance exhaust port 145A. Accordingly, oil pulsing from the advance chamber 124A deadheads at the advance check valve 158, flows through the advance chamber passage 150 around the spool valve 145 on the left side, deadheads against the spool valve 145 in the retard chamber passage 152 on the right side, flows through the exhaust check valve 170 around the spool valve 145 into the retard pulse passage 156 past the retard check valve 160 and into the retard chamber 124R. To retard in OPA mode, the spool valve shifts to the right to open the advance chamber passage 150 to the exhaust passage 165, which would be open to the sump 132. The shifting of the spool valve 145 to the left or right from the position in FIG. 7 may be controllably actuated in any suitable manner, for example, by a variable force solenoid (not shown).

FIGS. 8–13 illustrate an alternative embodiment of the present invention in which the change from a CTA mode (FIGS. 8–10) to an OPA mode (FIGS. 11–13) is responsive to a position of a centrifugally operated, and, therefore, radially extending control valve 288. The valve 288 moves to and fro within a valve body 280, which may be considered to extend radially within a rotating camshaft 226. At low rotational speeds of the camshaft 226, the valve 288 will be radially inwardly biased, to the left as shown in FIGS. 8–13, by a spring 286, and in the position of the valve 288 in FIGS. 8–10, no oil will be able to flow through the valve 288 to an exhaust line 232 that leads to an engine oil sump. In this position of the valve 288, oil will flow either from a retard chamber 224R of a fluid chamber 224 in a housing 212 to an advance chamber 224A of the chamber 224 (FIG. 8) or oil will flow from the advance chamber 224A to the retard chamber 224R (FIG. 9), or no oil will flow between the advance chamber 224A and the retard chamber 224R (FIG. 10), depending on the position of a spool element 290 that slides to and fro within a valve body 292. In that regard, the spool element 290 has spaced lands 290A, 290B that are adapted to block flow into or out of chambers 224A, 224R through lines 254, 256, respectively (FIG. 10), or to permit flow out of chamber 224R into chamber 224A (FIG. 8) through the valve body 292, or to permit flow out of chamber 224A into chamber 224R (FIG. 9) through the valve body 292, depending on the axial position of the spool 290 within the valve body 292. In that regard, the spool 290 is resiliently biased to its FIG. 8 position, one of its end positions, by a spring 294, which is positioned within the camshaft 226, the spring 294 acting on an end of the spool 290. The spool 290 is also urged to its FIGS. 9 and 10 positions by a variable force solenoid 290, which acts on an opposed end of the spool 290, the solenoid 296 being controlled in its operation by an electronic engine control unit 298, in a known manner.

Figure 9:
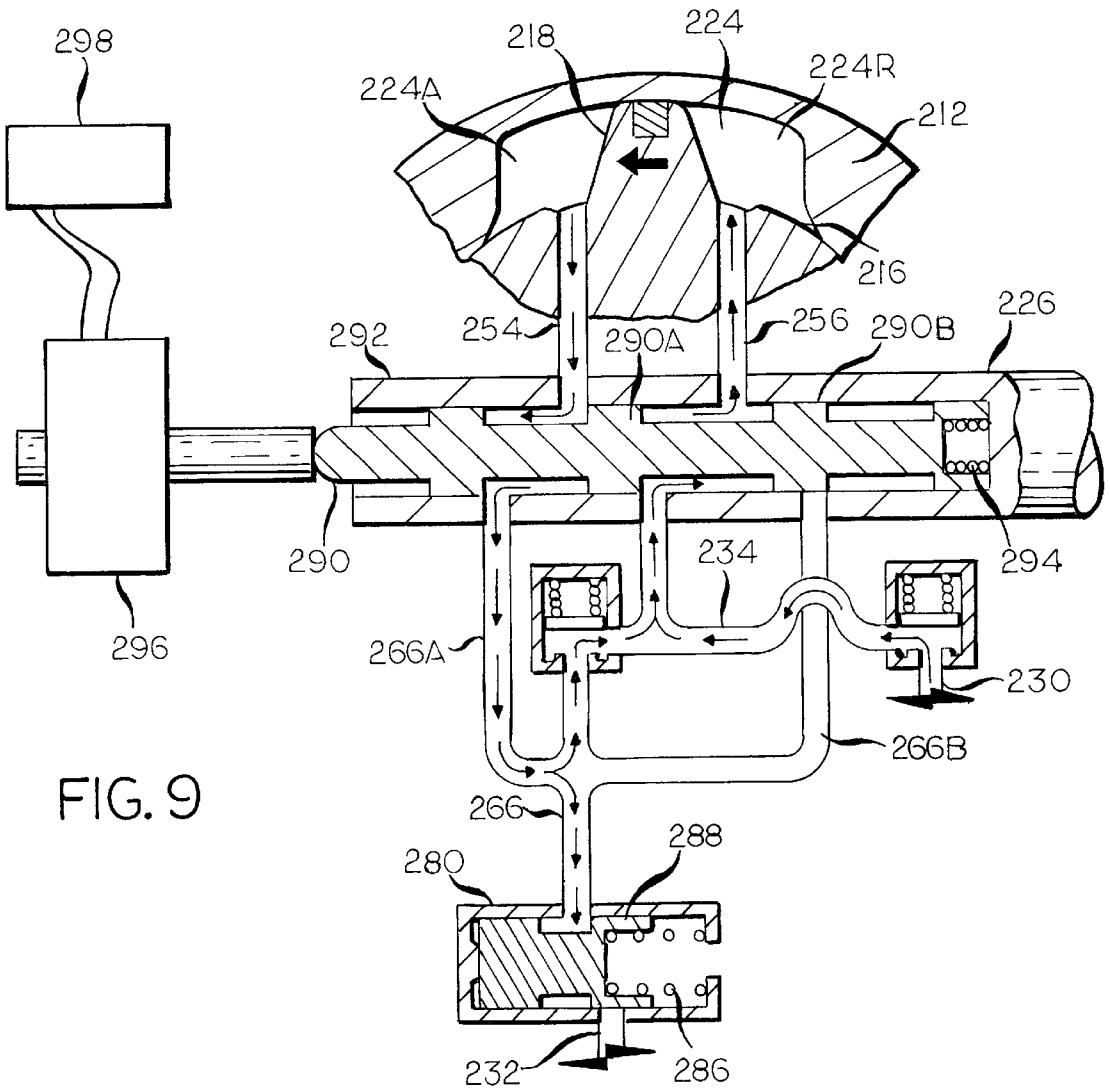
FIG. 9 is a view like FIG. 8 during a phase shift to a retard position.
Figure 10:
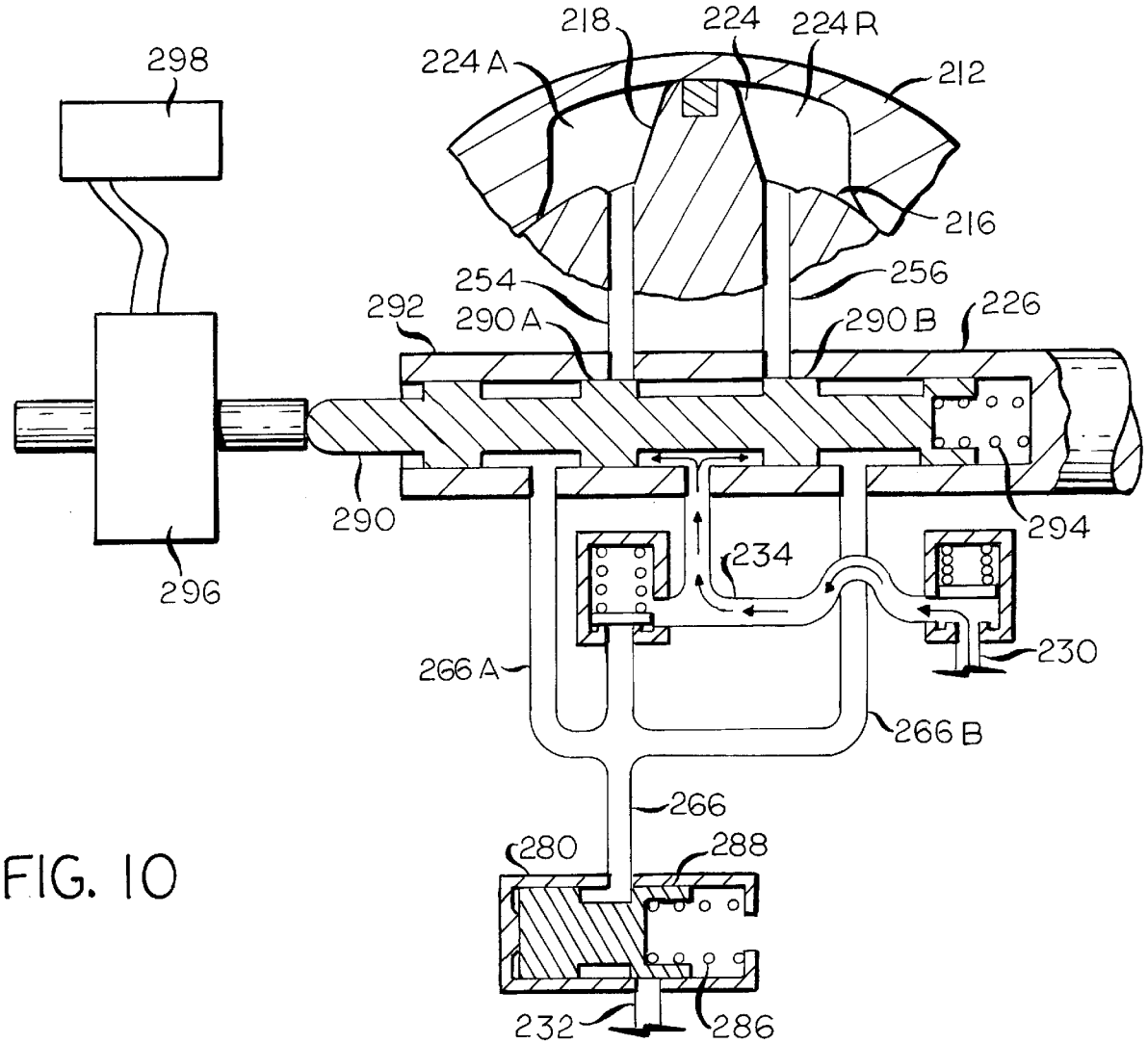
FIG. 10 is a view like FIGS. 8 and 9 in which the VCT is not operating to shift phase either to an advance position or to a retard position.
Figure 11:
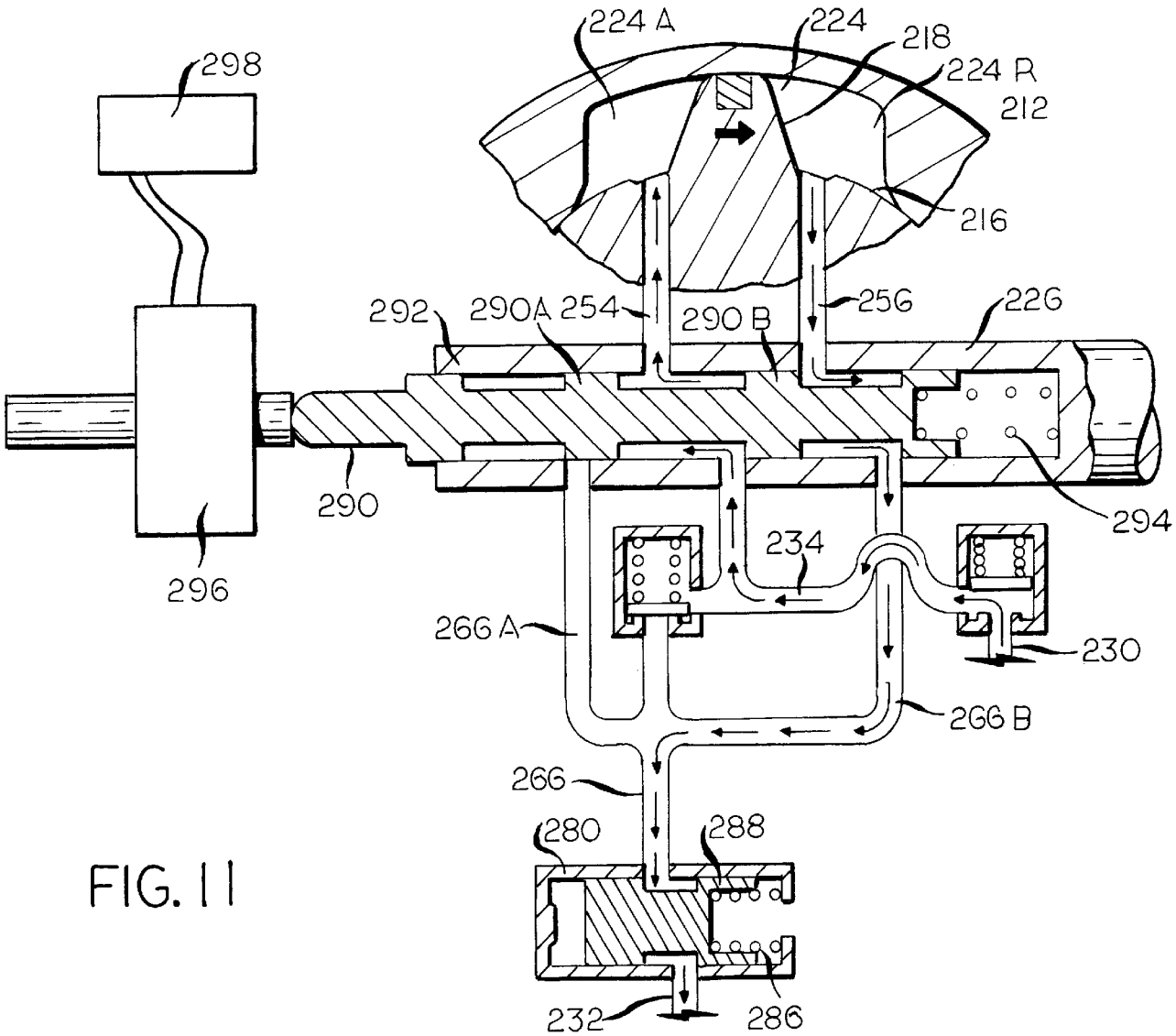
FIG. 11 is a schematic view of the embodiment of a VCT control system of FIGS. 8–10 operating in an OPA mode during a phase shift to an advance position.
Figure 12:
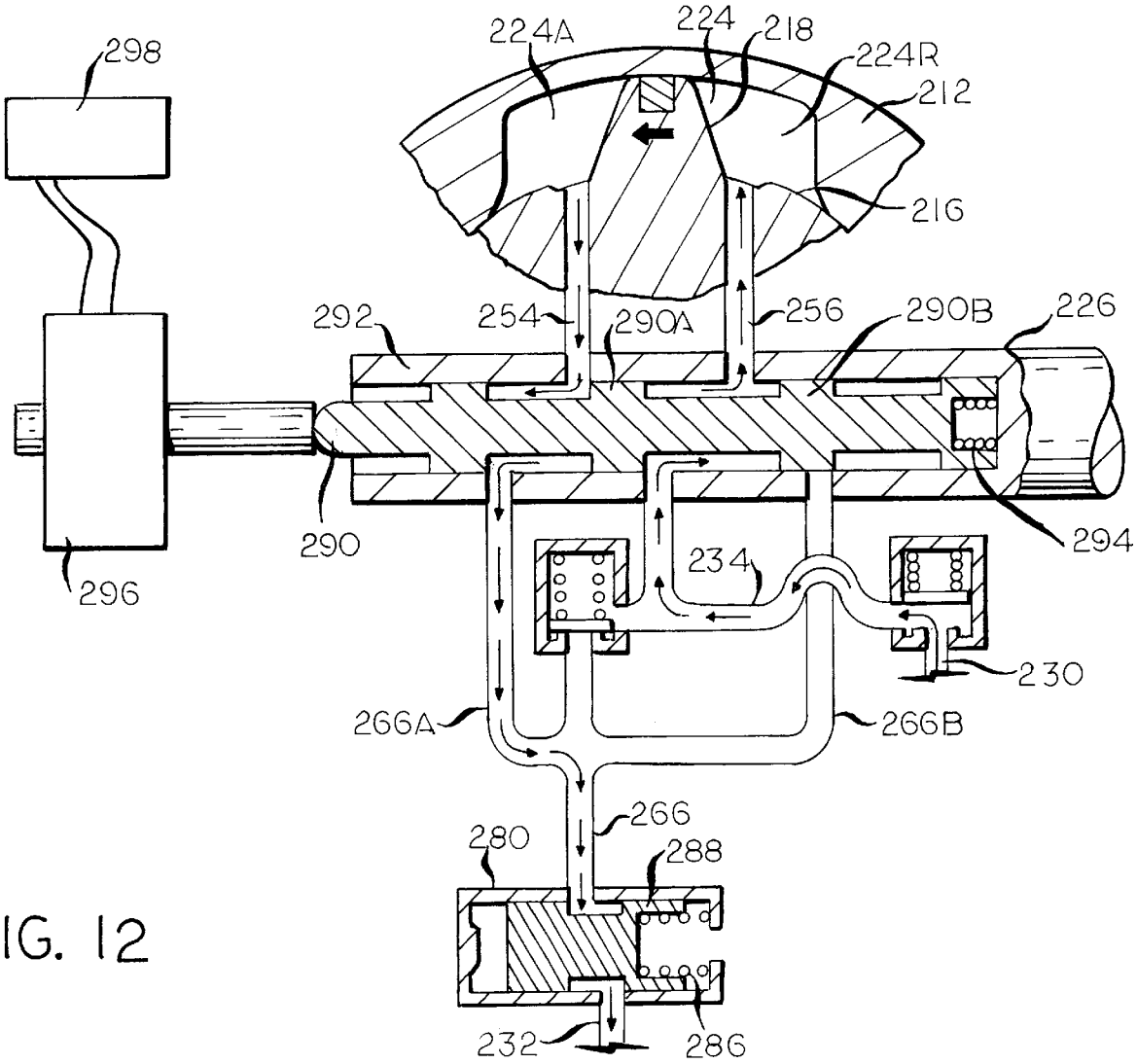
FIG. 12 is a view like FIG. 11 during a phase shift to a retard position.
Figure 13:
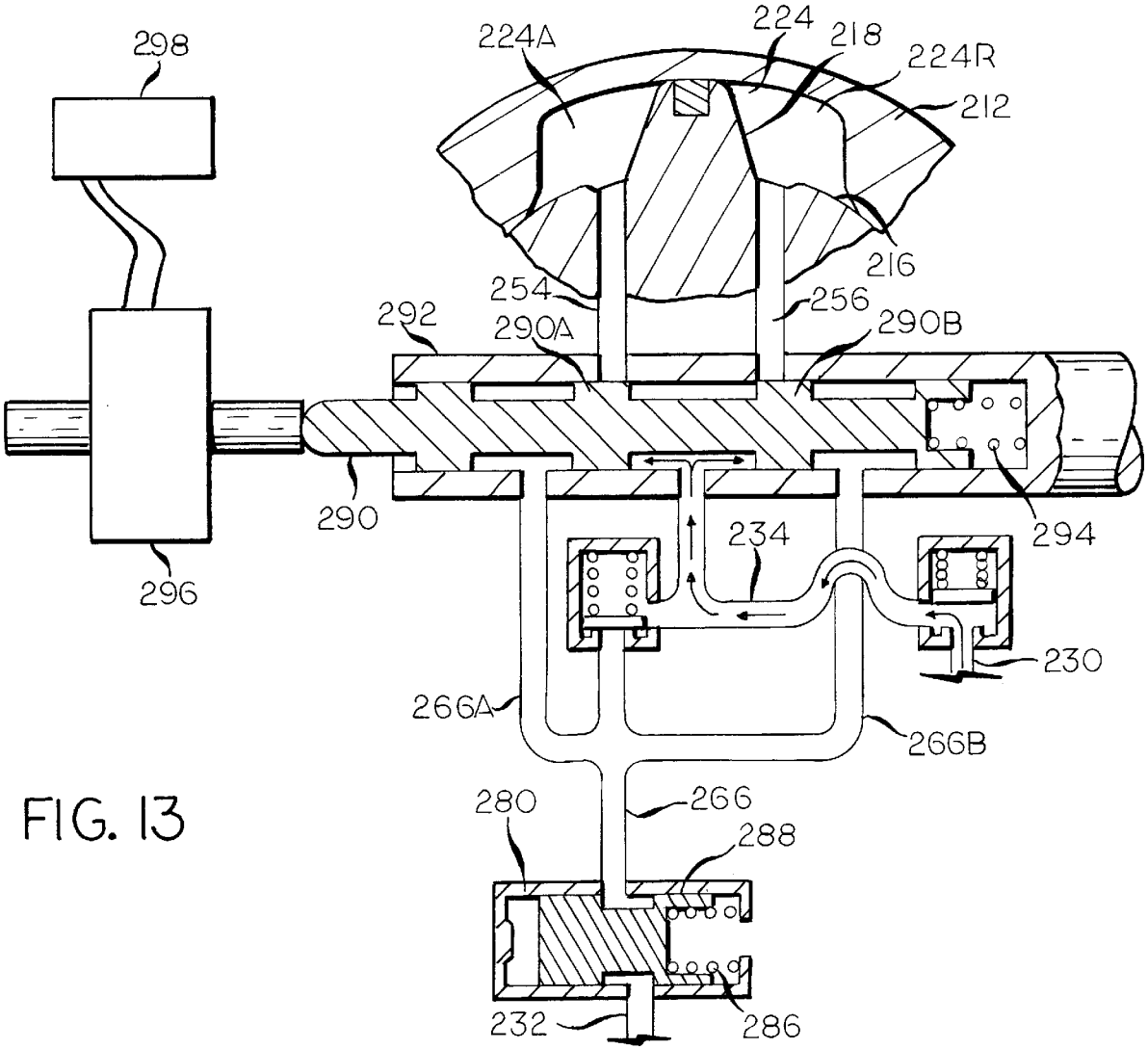
FIG. 13 is a view like FIGS. 11 and 12 in which the VCT is not operating to shift phase either to an advance position or to a retard position.

Control of oil flow into or out of the chambers 224A, 224R in an OPA mode of the embodiment of FIGS. 8–13 is illustrated in FIGS. 11, 12, the flow being out of the chamber 224R and into the chamber 224A in FIG. 11, or there will be no flow into or out of either chamber 224A or 224R, in FIG. 13 except for some leakage of make-up oil across the spool 290, depending on the axial position of the spool 290 within the valve body.

In FIG. 11, the land 290B is positioned to allow flow out of the chamber 224R through the line 256 and the valve body 292, but this flow now passes into the exhaust line 232 because of the position of the valve 280 within the valve body 280. At the same time, engine oil with flow into the chamber 224A from a source 230 through a line 234, the valve body 292 and the line 254, the land 290A being positioned to open the line 254 to inflow. In the FIG. 12 position of the spool 290, oil will flow from the source 230 through the line 234, the valve body 292 and the line 256 into the chamber 224R; at the same time, oil will flow out of the chamber 224A through the line 254, the valve body 292 and the valve body 280 into the exhaust line 232.

In FIG. 12, the land 290B is positioned to allow flow from the source 230 through the valve body and the line 256 into the chamber 224R, and the land 290A is positioned to allow flow out of the chamber 224A through the line 254, the valve body 292 and the valve body 288 into the exhaust line, 232, a line 266 with branches 266A, 266B extending between the valve body 288 and the valve body 292 to provide flow either from the chamber 224R to the valve body 288 through the branch line 266B and the line 266 (FIG. 11), or from the chamber 224A to the valve body 288 through the branch lines 266A and the line 266 (FIG. 12). In any case, the land 290A is positioned to block oil flow through the valve body 292 into the branch line 266A in the FIG. 11 condition of operating, and the land 290B is position to block oil flow from the valve body 292 into the branch line 266B in the FIG. 12 condition of operation.

Figure 8:
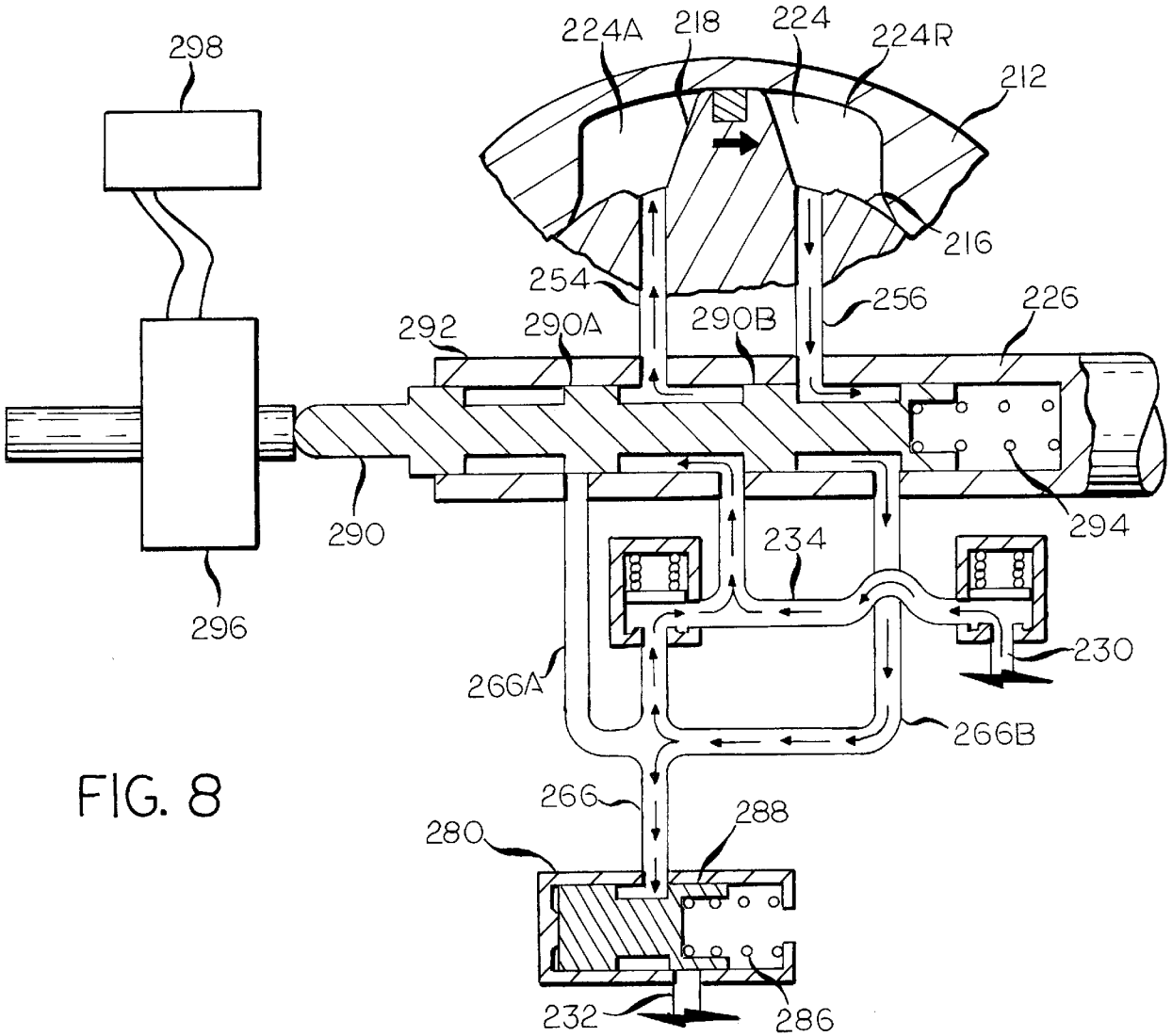
FIG. 8 is a schematic view of another and the secondarily preferred embodiment of a VCT control system according to the present invention operating in a CTA mode during a phase shift to an advance position.

The to and fro movement of the spool 290 in the valve body 292 in the OPA mode of operation of FIGS. 11–13 is the same as in the CTA mode of operation of FIGS. 8–10, namely under a variable force imposed on an end of the spool 290 by the variable force solenoid 296, which is opposed by a force imposed on an opposed end of the spool 290 by the spring 294. Likewise, the force imposed on the spool 290 by the solenoid 296 is controlled by the engine oil controller 298.

In the FIG. 13 condition of operation, there will be no oil flow into or out of the chamber 224R because the land 290B of the spool 290 is positioned to block flow through the line 256. Likewise, in this condition of operation there will be no oil into or out of the chamber 224A because the land 290A of the spool 290 is positioned to block flow through the line 254. In any case, it is to be understood that the solenoid 296 can be operated with some dither in either the FIG. 10 or the FIG. 13 conditions of the embodiment of FIGS. 8–13 to permit some small flow of make-up oil into the chambers 224A, 224R to replace any oil lost by leakage thereform.

From the above, it can be appreciated that a significant advantage of the present invention is that the camshaft may be advanced or retarded with respect to an engine crankshaft reliably over the entire speed range of any engine, regardless of either a lack of sufficient oil pump capacity or an absence of sufficient pulsations in the camshaft.

An additional advantage is that the VCT of the present invention involves inexpensive modifications to the control systems of already well known VCT hardware having oil passages therethrough.

While the present invention has been described in terms of a preferred embodiment, it is apparent that other forms could be adopted by one skilled in the art. Accordingly, the scope of the present invention is to be limited only by the following claims.

The invention claimed is:

1. A variable camshaft timing apparatus comprising:

pulse actuating means for oscillating said variable camshaft timing device in reaction to fluid under pulsation;

pressure actuating means for oscillating said variable camshaft timing device in reaction to fluid under pressure; and switching means for independently and simultaneously activating said pulse actuating means and said pressure actuating means;

whereby said variable camshaft timing device may be oscillated using one or both of said pulse actuating means and said pressure actuating means, and said variable camshaft timing device may be maintained anywhere in position between a fully advanced and a fully retarded condition, using one or both of said pulse actuating means and said pressure actuating means.

2. The variable camshaft timing apparatus as claimed in claim 1, and further comprising:

an advance chamber;

a retard chamber; and a fluid pressure source positioned in fluid communication between said advance and retard chambers.

3. The variable camshaft timing apparatus as claimed in claim 2 wherein said pulse actuating means comprises:

a pulsing path having opposite ends in fluid communication with said advance and retard chambers, said pulsing path comprising:

at least one pulse passage having means for preventing counterflow therein that permits flow to said advance chamber and prevents flow from said advance chamber;

valving means for activating said pulsing path and being in fluid communication with said at least one pulse passage; and a make-up circuit in fluid communication with said pulsing path for supplying fluid to each of said advance and retard chambers to make-up for fluid loss.

4. The variable camshaft timing apparatus as claimed in claim 3 wherein said valving means includes valves for permitting or preventing fluid from flowing through said at least one pulse passage, wherein one of said valves exhausts fluid through one of said at least one pulse passages from one of said advance and retard chambers through to the other of said advance and retard chambers, while another of said valves supplies make-up fluid from said fluid pressure source to the other of said advance and retard chambers.

5. The variable camshaft timing apparatus as claimed in claim 4 wherein said valving means further includes a normally closed exhaust valve positioned in fluid communication with said pulsing path, and wherein said exhaust valve remains closed during pulse actuated oscillation of said variable camshaft timing device.

6. The variable camshaft timing apparatus as claimed in claim 2 wherein said pressure actuating means comprises:

a pressure circuit in fluid communication with said advance and retard chambers, said pressure circuit serving to supply fluid to said advance and retard chambers and to return fluid under exhaust to said fluid pressure source, said pressure circuit comprising:

a supply path having one end in fluid communication with said fluid pressure source and having an opposite end in fluid communication with one of said advance and retard chambers, said supply path further having a one-way flow device therein for preventing counterflow back to said fluid pressure source;

an exhaust path having one end in fluid communication with the other of said advance and retard chambers and having an opposite end in fluid communication with said fluid pressure source; and switching means for activating said pressure circuit, said switching means being in fluid communication with said supply and exhaust paths of said pressure circuit.

7. The variable camshaft timing apparatus as claimed in claim 6 wherein said switching means includes a normally closed exhaust valve positioned between and in fluid communication with said supply and exhaust paths, and wherein said exhaust valve is opened during said pressure actuated oscillation of said variable camshaft timing device.

8. The variable camshaft timing apparatus as claimed in claim 7 wherein said switching means includes each of said supply and exhaust paths having a valve therein for permitting or preventing fluid flow therethrough, wherein one of said valves is positioned in one of said supply and exhaust paths to supply fluid from said fluid pressure source to one of said advance and retard chambers, while another of said valves is positioned in the other of said supply and exhaust paths to exhaust fluid from the other of said advance and retard chambers through said exhaust valve.

9. A variable camshaft timing apparatus according to claim 7 wherein said switching means comprises:

a centrifugally operated valve (280) for selectively permitting oil to flow from between the advance chamber (224A) and the retard chamber (224R) without passing through the centrifugally operated valve to an exhaust line (232) or for permitting oil to flow from one of the advance chamber or the retard chamber through the centrifugally operated valve to the exhaust line.

10. Apparatus according to claim 9 and further comprising:

a double-ended axially slidable spool valve (290) having spaced apart lands for controlling flow into or out of the advance chamber and the retard chamber;

a spring acting on an end of the spool valve to urge the spool valve in a first direction; and an electronically controlled, variable force solenoid acting on an opposed end of the spool valve to urge the spool valve in an opposed direction.

11. A control system for a variable camshaft timing apparatus connected to a fluid pressure source (30), said control system comprising:

an advance chamber (24A);

a retard chamber(24R);

a pulse actuating means for oscillating said variable camshaft timing apparatus, said pulse actuating means interconnecting said advance and retard chambers, wherein said pulse actuating means comprises:

a retarding pulse means (50,44,56) for conveying fluid under pulsation from said advance chamber to said retard chamber, said retarding pulse means including means (60) for preventing counterflow from said retard chamber; and an advancing pulse means (52,46,54) for conveying fluid under pulsation from said retard chamber to said advance chamber, said advancing pulse means including means (58) for preventing counterflow from said advance chamber;

a pressure actuating means for oscillating said variable camshaft timing apparatus, said pressure actuating means comprising:

a retarding pressure supply means (34,46,52) for supplying fluid from said fluid pressure source to said retard chamber;

a retarding pressure exhaust means (50,44,64,180,32) for exhausting fluid from said advance chamber back to said fluid pressure source;

an advancing pressure supply means (34,44,50) for supplying fluid from said fluid pressure source to said advance chamber;

an advance pressure exhaust means (52,46,66,180, 32) for exhausting fluid from said retard chamber back to said fluid pressure source; and means (40, 42) for preventing counterflow from said advance and retard chambers back to said fluid pressure source.

12. The control system as claimed in claim 11, further including;

switching means for activating said pressure actuating means, said switching means including a normally closed exhaust valve (80,180) in fluid communication with both of said pulse actuating means and said pressure actuating means, wherein said exhaust valve is opened during pressure actuated oscillation.

13. The control system as claimed in claim 12, wherein said exhaust valve is oil pressure activated and includes a spring (86) and a double-ended piston (182) urged closed by said spring to close said exhaust valve, wherein fluid under a predetermined pressure acts on one end of said piston thereby overcoming the spring force of said spring to open said exhaust valve and permit fluid to flow therethrough, and wherein the spring force of said spring acts on another end of said piston to close said exhaust valve when said fluid falls below said predetermined pressure.

14. The control system as claimed in claim 12 wherein said exhaust valve is centrifugally activated and includes a radially disposed spring (86) and a radially disposed piston (82) urged closed by said spring, wherein said piston is displaced radially outwardly, thereby overcoming the spring force of said spring under a predetermined rotational speed of said variable camshaft timing device.

15. The control system as claimed in claim 12 wherein said exhaust valve is electronically activated, and said exhaust valve includes a normally closed solenoid valve (194), wherein said solenoid valve is opened upon receiving an electronic signal.

16. The control system as claimed in claim 12, wherein said switching means further includes each of said pulse actuating means and pressure actuating means sharing two valves (44,46):

wherein one of said two valves (44 or 46) permits fluid flow from said advance chamber to said retard chamber through said retarding pulse means during retarding oscillation of said variable camshaft timing device and permits fluid flow from said fluid supply source to said advance chamber through said advancing pressure supply means during advancing oscillation of said variable camshaft device; and wherein the other of said two valves (44 or 46) permits fluid flow from said retard chamber to said advance chamber through said advancing pulse means during advancing oscillation of said variable camshaft timing device and permits fluid flow from said fluid supply source to said retard chamber through said retarding pressure supply means during retarding oscillation of said variable camshaft device.

17. A variable camshaft timing apparatus attached to a camshaft (26), said variable camshaft timing apparatus comprising:

a hub (16) attached to said camshaft and being rotatable but not oscillatable with respect to said camshaft;

a housing (12) circumscribing said hub to define at least one fluid chamber (24) therebetween, said housing being rotatable and oscillatable with respect to said camshaft;

said hub having at least one vane member (22) dividing said at least one fluid chamber into at least one advance chamber (24A) and at least one retard chamber (24R);

a fluid pressure source (30) in fluid communication with said at least one advance and retard chambers, said fluid pressure source having a inlet side (30I) and an outlet side (30O) opposite said inlet side;

a fluid supply passage (34) in fluid communication with said outlet side of said fluid pressure source, said fluid supply passage having at least one check valve (40, 42) for preventing counterflow of fluid back to said fluid pressure source;

an advance valve (44) having a supply port (44S) in fluid communication with said fluid supply passage, said advance valve further having a control port (44C) communicable with said supply port, said advance valve further having an exhaust port (44E) communicable with said control port;

an advance chamber passage (50) having one end in fluid communication with said control port of said advance valve and having an opposite end in fluid communication with said at least one advance chamber;

a retard valve (46) having a supply port (46S) in fluid communication with said fluid supply passage, said retard valve further having a control port (44C) communicable with said supply port, and an exhaust port (44E) communicable with said control port;

a retard chamber passage (52) having one end in fluid communication with said control port of said retard valve and having an opposite end in fluid communication with said at least one retard chamber;

a retard pulse passage (56) having one end in fluid communication with said exhaust port of said advance valve and having an opposite end in fluid communication with said at least one retard chamber, said retard pulse passage having a check valve (60) therein for permitting flow from said at least one advance chamber and for preventing flow from said at least one retard chamber;

an advancing pulse passage (54) having one end in fluid communication with said exhaust port of said retard valve and having an opposite end in fluid communication with said at least one advance chamber, said advancing pulse passage having a check valve (58) therein for permitting flow to said at least one advance chamber and for preventing flow from said at least one advance chamber;

a retard exhaust passage (64) having one end in fluid communication with said exhaust port of said advance valve, said retard exhaust passage terminating in an opposite end;

an advancing exhaust passage (66) having one end in fluid communication with said exhaust port of said retard valve, said advancing exhaust passage terminating in an opposite end;

an exhaust valve (80,180) in fluid communication with said opposite ends of said retard and advancing exhaust passages for exhausting flow from said at least one advance chamber during fluid pressure actuated retarding of said variable camshaft timing device and for exhausting flow from said at least one retard chamber during fluid pressure actuated advancing of said variable camshaft timing device; and a sump (32) in fluid communication with said exhaust valve and said inlet side of said fluid pressure source and being interposed therebetween;

said hub being oscillatable with respect to said housing in response to fluid pulsations from one of said at least one advance and retard chambers to other of said at least one advance and retard chambers;

said hub being oscillatable with respect to said housing in response to fluid pressure from said fluid pressure source to one of said at least one advance and retard chambers; and said hub being maintainable in position with respect to said housing in response to fluid pressure from said fluid pressure source to both of said at least one advance and retard chambers.

18. A variable camshaft timing apparatus attached to a camshaft (26), said variable camshaft timing apparatus comprising:

a hub (16) attached to said camshaft and being rotatable but not oscillatable with respect to said camshaft;

a housing (12) circumscribing said hub to define at least one fluid chamber (24) therebetween, said housing being rotatable and oscillatable with respect to said camshaft;

said hub having at least one vane member (22) dividing said at least one fluid chamber (24A) into at least one advance chamber and at least one retard chamber (24R);

a fluid pressure source (130) in fluid communication with said at least one advance and retard chambers, said fluid pressure source having a inlet side (130I) and an outlet side (130O) opposite said inlet side;

a fluid supply passage (134) in fluid communication with said outlet side of said fluid pressure source, said fluid supply passage having at least one check valve (140 or 142) for preventing counterflow of fluid back to said fluid pressure source;

a spool valve (145) having a supply port (145S) in fluid communication with said fluid supply passage, said spool valve further having a retard exhaust port (145R), and an advance exhaust port (145A);

an advance chamber passage (150) having one end in fluid communication with said advance exhaust port of said spool valve and having an opposite end in fluid communication with said at least one advance chamber;

a retard chamber passage (152) having one end in fluid communication with said retard exhaust port of said spool valve and having an opposite end in fluid communication with said at least one retard chamber;

a retard pulse passage (156) having one end in fluid communication with said supply port of said spool valve and having an opposite end in fluid communication with said at least one retard chamber, said retard pulse passage having a check valve (160) therein for permitting flow from said at least one advance chamber and for preventing flow from said at least one retard chamber;

an advance pulse passage (154) having one end in fluid communication with said supply port of said spool valve and having an opposite end in fluid communication with said at least one advance chamber, said advance pulse passage having a check valve (158) therein for permitting flow to said at least one advance chamber and for preventing flow from said at least one advance chamber;

an exhaust valve (180) in fluid communication with said advance and retard exhaust ports of said spool valve, said exhaust valve for exhausting flow from said at least one advance chamber during fluid pressure actuated retarding of said variable camshaft timing device and for exhausting flow from said at least one retard chamber during fluid pressure actuated advancing of said variable camshaft timing device; and a sump (132) in fluid communication with said exhaust valve and said inlet side of said fluid pressure source and being interposed therebetween;

said hub being oscillatable with respect to said housing in response to fluid pulsations from one of said at least one advance and retard chambers to other of said at least one advance and retard chambers;

said hub being oscillatable with respect to said housing in response to fluid pressure from said fluid pressure source to one of said at least one advance and retard chambers; and said hub being maintainable in position with respect to said housing in response to fluid pressure from said fluid pressure source to both of said at least one advance and retard chambers.

* * * * *